US006142531A

United States Patent [19]

Harris, II

[11] Patent Number: 6,142,531

[45] Date of Patent: Nov. 7, 2000

[54] UNIVERSAL TAMPERPROOF LASER IDENTIFICATION CARDS AND SINGLE PASS POST CARDS

[76] Inventor: C Whit Harris, II, 211 Natures Trail, Fort Walton Beach, Fla. 32548

[21] Appl. No.: 09/336,857

[22] Filed: Jun. 21, 1999

[51] Int. Cl.[7] ..... B42D 15/00

[52] U.S. Cl. ..... 283/74; 283/75; 283/106

[58] Field of Search ..... 283/74, 75, 77, 283/36, 106, 107, 109

[56] References Cited

U.S. PATENT DOCUMENTS

| | | | |
|---|---|---|---|
| 4,510,006 | 4/1985 | Lawson | 283/74 |
| 5,074,593 | 12/1991 | Grosso | 283/77 |
| 5,372,385 | 12/1994 | Sufuentes et al. | 283/61 |
| 5,403,236 | 4/1995 | Greig | 283/74 |
| 5,601,313 | 2/1997 | Konkol et al. . | |
| 5,653,472 | 8/1997 | Huddleston et al. . | |
| 5,662,976 | 9/1997 | Popat et al. | 428/40.1 |
| 5,664,725 | 9/1997 | Walz . | |
| 5,746,450 | 5/1998 | Petkovsek . | |
| 5,765,875 | 6/1998 | Rowley | 283/74 |
| 5,873,606 | 2/1999 | Haas et al. | 283/75 |
| 5,873,607 | 2/1999 | Waggoner | 283/81 |
| 5,895,074 | 4/1999 | Chess et al. | 283/74 |
| 5,915,733 | 6/1999 | Schnitzer et al. | 283/74 |
| 6,013,154 | 1/2000 | Thomas-Cote | 283/81 |

*Primary Examiner*—A. L. Wellington
*Assistant Examiner*—Monica Carter
*Attorney, Agent, or Firm*—Michael I. Kroll

[57] ABSTRACT

A foldable card for providing information to a user including a backing sheet, a printable sheet and an adhesive material on one side of the printable sheet releasably securing the backing and printable sheets together. The printable sheet includes first and second sections having substantially similar dimensions connected together at a fold line. Information is printable on a side of the first and second sections opposite the adhesive material during a single pass through a printer. When the printable sheet is removed the backing sheet and folded along the fold line, the adhesive material on the first and second sections secures the first and second sections together allowing the information printed on both the first and second section to be viewable. The foldable card may be produced in any shape such as a post card or I.D. tag. When used as an I.D. tag the first section may include a window through which an item between the first and second sections is viewable. First and second tabs extend from a respective one of the first and second sections and include an adhesive material on one side thereof causing them to be secured together when the foldable card is folded along the fold line and slits extending therethrough for receiving a button and releasably securing the folding card to clothing of a user. An extension portion extends from one tab and includes an adhesive material on one side thereof for selectively adhering the foldable card to an object.

11 Claims, 12 Drawing Sheets

UNIVERSAL TAMPERPROOF LASER IDENTIFICATION CARDS AND SINGLE PASS POST CARDS

BACKGROUND OF THE INVENTION

1. Field of the Invention

The present invention relates generally to labels and, more specifically, to a card including first and second sides connected along a fold line, the first and second sides each having an adhesive material positioned on one side thereof securing the first and second sides together when folded along the fold line. Information may be printed on the side opposite the adhesive material during a single pass through a printer. Furthermore, the first side may include a window extending therethrough whereby when a photo is positioned thereunder and the card is folded along the fold line, the photo is held in position beneath the window. A tab including a plurality of slits extending therethrough may also extend from the first and second sides, the slits acting to releasably secure the identification card to a button on clothing of the user.

2. Description of the Prior Art

Numerous types of labels have been provided in the prior art. For example, U.S. Pat. No. 5,601,313; 5,653,472; 5,664,725; 5,746,450 all are illustrative of such prior art. While these units may be suitable for the particular purpose to which they address, they would not be as suitable for the purposes of the present invention as heretofore described.

U.S. Pat. No. 5,601,313

Inventor: Patrick A. Konkol

Issued: Feb. 11, 1997

A multipart form and label combination is provided which may be printed in a single pass through a printer. The combination includes a face ply which may be printed with nonvariable and variable indicia, a film ply and an optional intermediate liner ply. The combination also includes first, second, or third removable portions such as, for example, a label receipt or postcard. In a preferred embodiment, the multipart form and label combination is used as an inspection form.

U.S. Pat. No. 5,653,472

Inventor: Joey V. Huddleston et al.

Issued: Aug. 5, 1997

A form having detachable labels and a wrist band is provided. The form includes a face ply adhered to a liner ply by a pressure sensitive adhesive. The face ply includes a first portion and a second portion, where the first portion is die cut to form a wristband and a second portion is die cut to form a series of detachable labels. The form may be printed in a single pass through a printer to provide the wristband and labels with correlating printed indicia.

U.S. Pat. No. 5,664,725

Inventor: Gerard F. Walz

Issued: Sep. 9, 1997

A multi-part mailing form has two superimposed sheets of material such as paper stock which are secured together in adhered areas by an adhesive layer between the sheets. The inner face of a lower sheet is coated with a non-adhesive material in certain areas so that the sheets are not adhered in these areas. The coated areas of the lower sheet correspond to detachable areas of the upper sheet which can be detached and secured to an item to be mailed. Sections of the form are separable from one another by cutting or by means of tear lines. One of the separable sections has imprinted indicia on the outer face of each sheet and includes a return postcard for confirming receipt of a mailed item.

U.S. Pat. No. 5,746,450

Inventor: Glenn Petkovsek

Issued: May 5, 1998

An assembly for mailing an article requiring special services and a method for mailing same are provided. The assembly includes a single sheet constructed in such a way that one portion of the sheet provides a label and the other portion provides a return postcard or other special service form for attachment to an envelope in its assembled position. The sheet includes a backing to which the portions are attached. The backing may include a section that is cut out to expose one or more of the portions. The return postcard is integrally formed, but removably attached, such that the return postcard remains attached to the envelope until received by the addressee, at which time the return postcard may be removed.

SUMMARY OF THE PRESENT INVENTION

The present invention relates generally to labels and, more specifically, to a card including first and second sides connected along a fold line, the first and second sides each having an adhesive material positioned on one side thereof securing the first and second sides together when folded along the fold line. Information may be printed on the side opposite the adhesive material during a single pass through a printer. Furthermore, the first side may include a window extending therethrough whereby when a photo is positioned thereunder and the card is folded along the fold line, the photo is held in position beneath the window. A tab including a plurality of slits extending therethrough may also extend from the first and second sides, the slits acting to releasably secure the identification card to a button on clothing of the user.

A primary object of the present invention is to provide a folding card that will overcome the shortcomings of prior art devices.

Another object of the present invention is to provide a folding card able to be formed on a multi-ply sheet comprising a printable ply and a backing ply including an adhesive material positioned on one side of the printable ply wherein a plurality of folding cards may be formed on a single multi-ply sheet.

Yet another object of the present invention is to provide a foldable card having first and second sides connected along a fold line wherein information may be printed on both the first and second sides of the printable ply during a single pass of the sheet through a printer.

Still yet another object of the present invention is to provide a foldable card having a window positioned on one of the first and second sides thereof for viewing an item inserted between the first and second sides when the card is folded along the fold line.

Another object of the present invention is to provide a foldable card having a tab extending from at least one of the first and second sides including at least one of an adhesive material positioned on a portion of the tab for selectively adhering the card to clothing surfaces and a slotted portion having a plurality of various sized slits extending therethrough for receiving a clothing button therethrough.

A still further object of the present invention is to provide a foldable card in the form of a post card having a front side and a back side joined together along a fold line and releasably secured to a sheet by an adhesive material, whereby the side opposite the adhesive material allows for printing an address on the front side and a message on the back side of the foldable card during a single pass through a printer.

Additional objects of the present invention will appear as the description proceeds.

The present invention overcomes the shortcomings of the prior art by providing a plurality of removably foldable cards having a printable side and an adhesive side mounted on a backing sheet. The card may include a window covered by a transparent material for viewing an insert, e.g. a photograph, positioned between the first and second sides forming a tamperproof identification card and having a tab extending from at least one of the first and second sides for attaching the card to an article of clothing. The tab may include an adhesive portion for selectively adhering the foldable card to exterior clothing surfaces and/or a slotted portion having a plurality of various sized slits for alternately inserting a clothing button therethrough.

Additionally a second embodiment is provided having a post card releasably mounted to a backing sheet having front and back surfaces of the postcard connected together along a fold line. The printable facing ply of the first and second surfaces face in the same direction thereby permitting printing of the address and message in one pass through a printer. When the post card is removed from the backing sheet and folded along the fold line the adhesively backed surfaces are securely and unattachably engaged.

The foregoing and other objects and advantages will appear from the description to follow. In the description reference is made to the accompanying drawing, which forms a part thereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
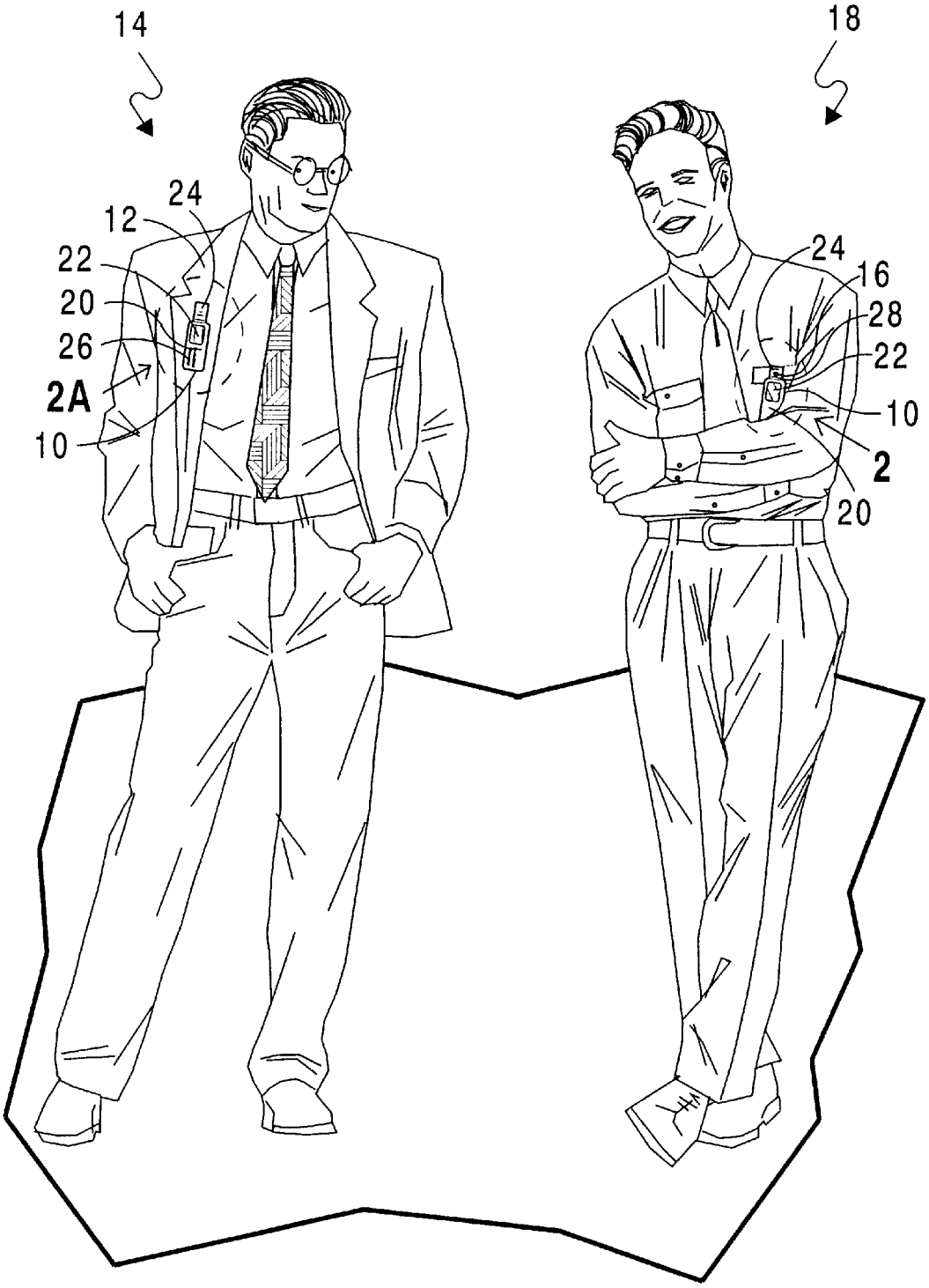
FIG. 1 is a perspective view of the foldable card of the present invention adhered to a lapel of a user and releasably secured to a button of another user.

Turning now descriptively to the drawings, in which similar reference characters denote similar elements throughout the several views, the Figures illustrate the foldable cards of the present invention. With regard to the reference numerals used, the following numbering is used throughout the various drawing figures.

10 foldable card of the present invention
12 lapel
14 first user of foldable card
16 button
18 second user of foldable lapel
20 face side of foldable card
22 window in face side
24 tab extending from face side
26 information printed on face side
28 plurality of slits extending through tab
30 clothing of user
32 sheet of transparent material covering window
34 photograph viewable through window
36 extension portion of tab

38 sheet retaining a plurality of folding cards
40 back side of folding card
42 folding line between front and back sides
42 tab extending from back side
46 plurality of slits in tab extending from back side
48 bottom side of folding card
50 adhesive material on bottom side of folding card
52 cover on extension portion
54 perforations connecting extension portion to tab of front side
56 arrow indicating direction of peeling of cover of extension portion
58 arrow indicating removal of cover from extension portion
60 multi-ply sheet
61 perforated line
62 postcards
64 front surface of post card
66 back surface of postcard
68 fold line between front and back surfaces
70 adhesive material
72 bottom side of post card
74 removable cover covering adhesive material on bottom side of post card 4
76 arrows indicating direction of folding along fold line

DETAILED DESCRIPTION OF THE PREFERRED EMBODIMENT

Turning now descriptively to the drawings, in which similar reference characters denote similar elements throughout the several views, FIGS. 1 through 13A illustrate the foldable cards of the present invention indicated generally by the numeral 10.

The foldable card 10 of the present invention may be used for numerous purposes as is illustrated throughout the figures. FIGS. 1–8 illustrate the use of the foldable card 10 as an identification card. The foldable card 10 is illustrated both adhered to a lapel 12 of a first user 14 and releasably secured to a button 16 of a second user 18.

The foldable card 10 shown adhered to the lapel 12 of the first user 14 includes a face side 20 having a window 22 extending therethrough and a tab 24 extending therefrom. Information 26 may also be printed on the face side 20. An adhesive material is provided on an opposite side of the tab 24. The tab 24 also includes a plurality of slits 28 extending therethrough. The plurality of slits 28 are provided to receive a button 16 on the clothing of a user, e.g. the second user 18. The foldable card 10 is releasably secured to the button 16 by simply sliding the button 16 through one of the slits 28 similar to passing a button through a button hole when closing a garment.

Figure 2:
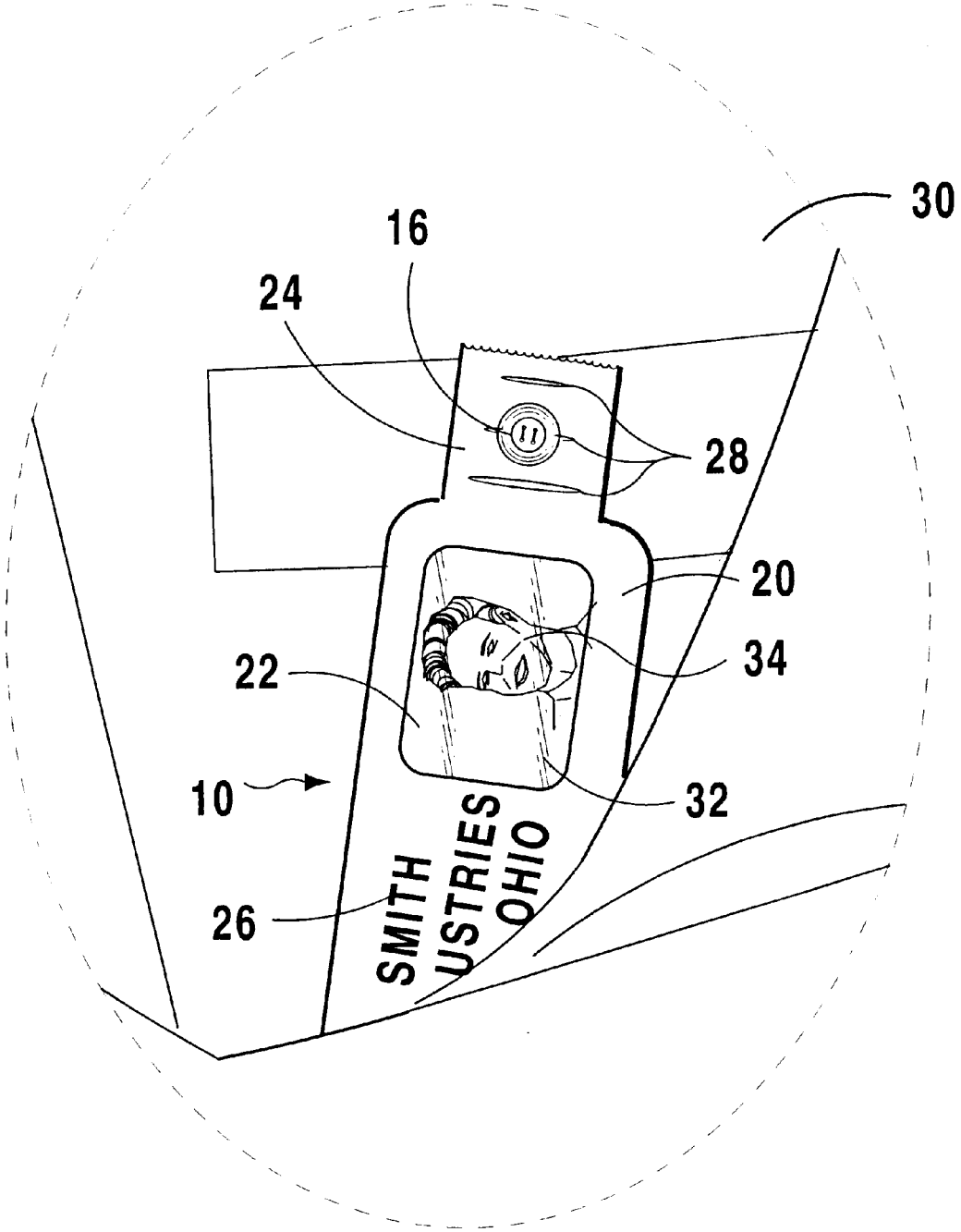
FIG. 2 is an enlarged view of the foldable card of the present invention taken from within the circle labeled 2 of FIG. 1 and showing the foldable card releasably secured to a button.

An enlarged view of the foldable card 10 releasably secured to a button 16 on the clothing 30 of the second user 18 and taken from within the circle labeled 2 of FIG. 1 is illustrated in FIG. 2. The button 16 is passed through one of the slits 28, the slits 28 acting as a button hole, to releasably secure the foldable card 10 thereto. The foldable card 10 will then be able to hang from the button 16 as shown in the figure. The window 22 is preferably covered by a sheet of transparent material 32. Positioned behind the window 22 and viewable through the transparent material 32 is an item of information such as a photograph 34 providing additional identification information about the user. A back side of the photograph 34 is positioned between the transparent material 32 covering the window 22 and a back side of the folding card 10. The back side is adhered to the face side 20 for retaining the photograph 34 therebetween and positioned beneath the window 22. The back side will be discussed hereinafter with specific reference to FIGS. 3–6 and 8.

Figure 2A:
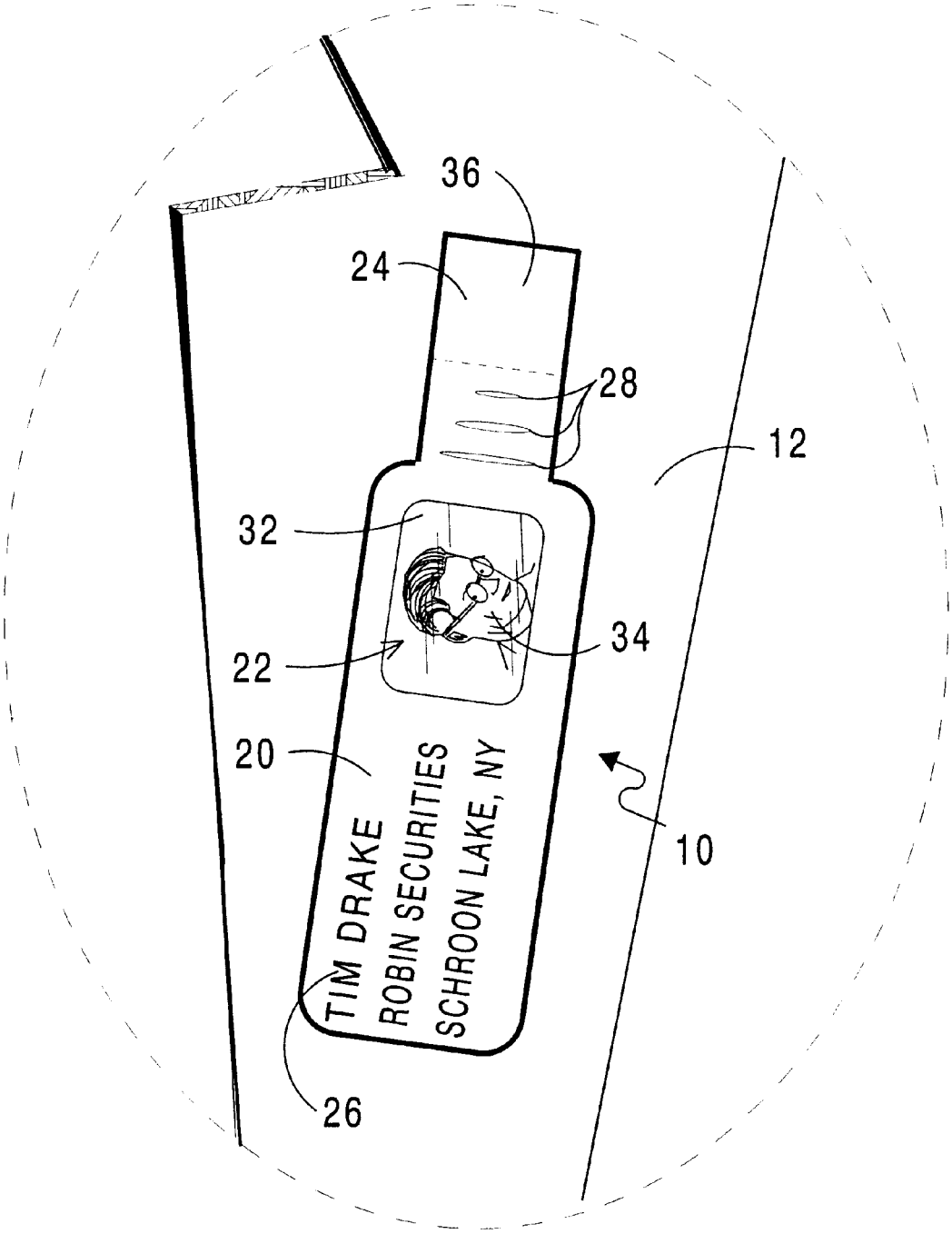
FIG. 2A is an enlarged view of the foldable card of the present invention taken from within the circle labeled 2A of FIG. 1 and showing the foldable card releasably adhered to a lapel.

An enlarged view of the foldable card 10 releasably adhered to a lapel 12 of the clothing 30 of the first user 14 is illustrated in FIG. 2A. As can be seen from this view, the foldable card 10 includes the face side 20 having the window 22 extending therethrough and the tab 24 extending from one end thereof. Information 26 is also printed on the face side 20 and a photograph 34 is positioned below the sheet of transparent material 32 covering the window 22. An extension portion 36 of the tab 24 is provided extending therefrom on a side of the slits 28 opposite the connection to the face side 20. On an opposite side of the extension portion 36 is an adhesive material for adhering the foldable card 10 to the lapel 12 or any other piece of clothing 30 of the user. The adhesive material on the extension portion 36 will be shown and described in more detail hereinafter.

Figure 3:
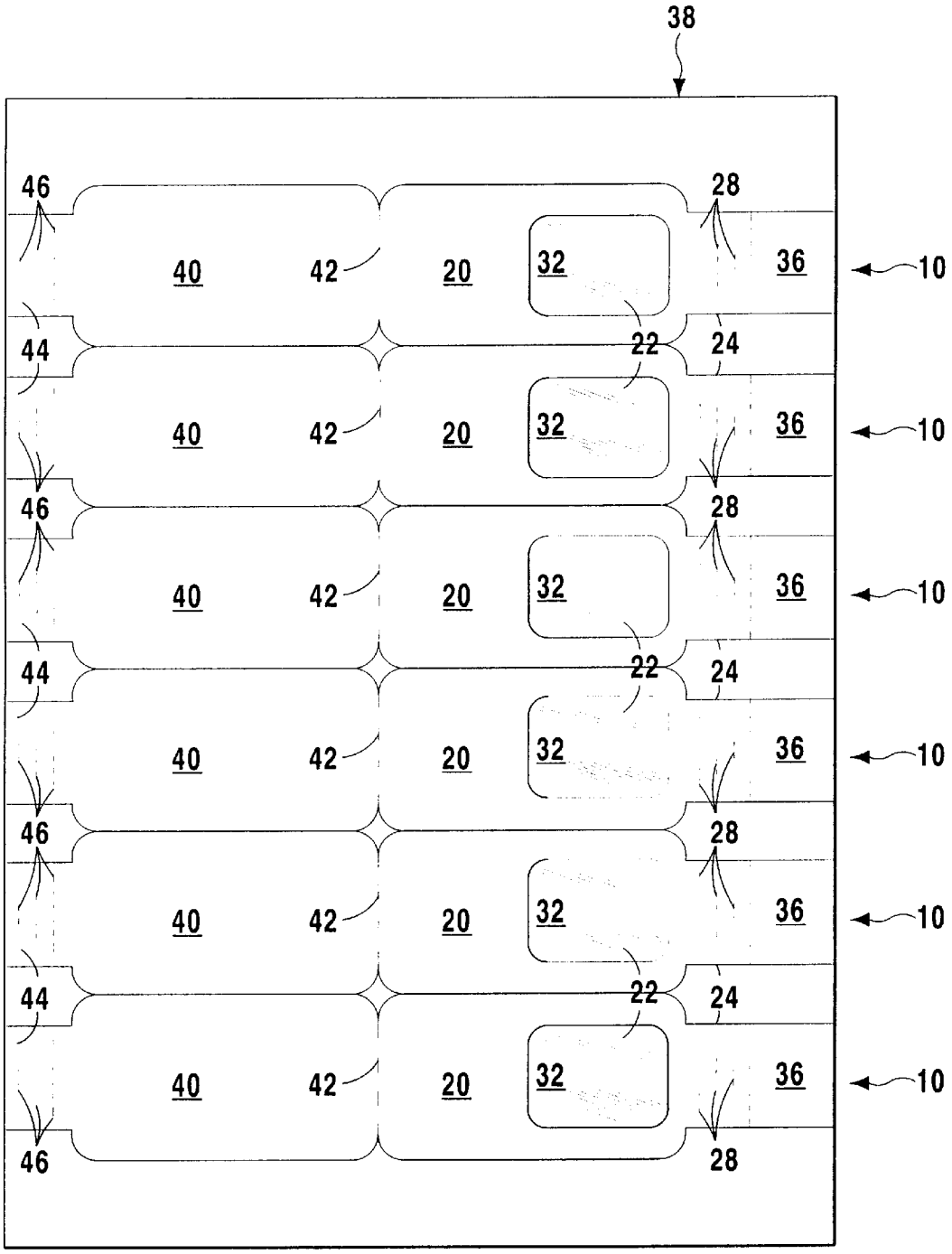
FIG. 3 is a front elevation of a full sheet including a plurality of foldable cards in accordance with the present invention.

A full sheet 38 containing a plurality of foldable cards 10 thereon is illustrated in FIG. 3. As can be seen from this figure, the face side 20 of each of the plurality of foldable cards 10 is connected to a back side 40 along a fold line 42. The back side 40 of each foldable card 10 includes a tab 44 extending therefrom on a side opposite the fold line 42 and a plurality of slits 46 extending through the tab 44. The back side 40 is substantially identical in dimensions to the face side 20. However, the back side 40 does not include an extension portion 36 extending from an end of the tab 44. This figure shows the top side 48 of the foldable cards 10 on which information may be printed on a single pass through a printer to print the information on both the front and back of each foldable card 10. On a bottom side of each foldable card 10 opposite the top side 48 and releasably securing the foldable card to the sheet 38 is an adhesive material as will be described hereinafter.

Figure 4:
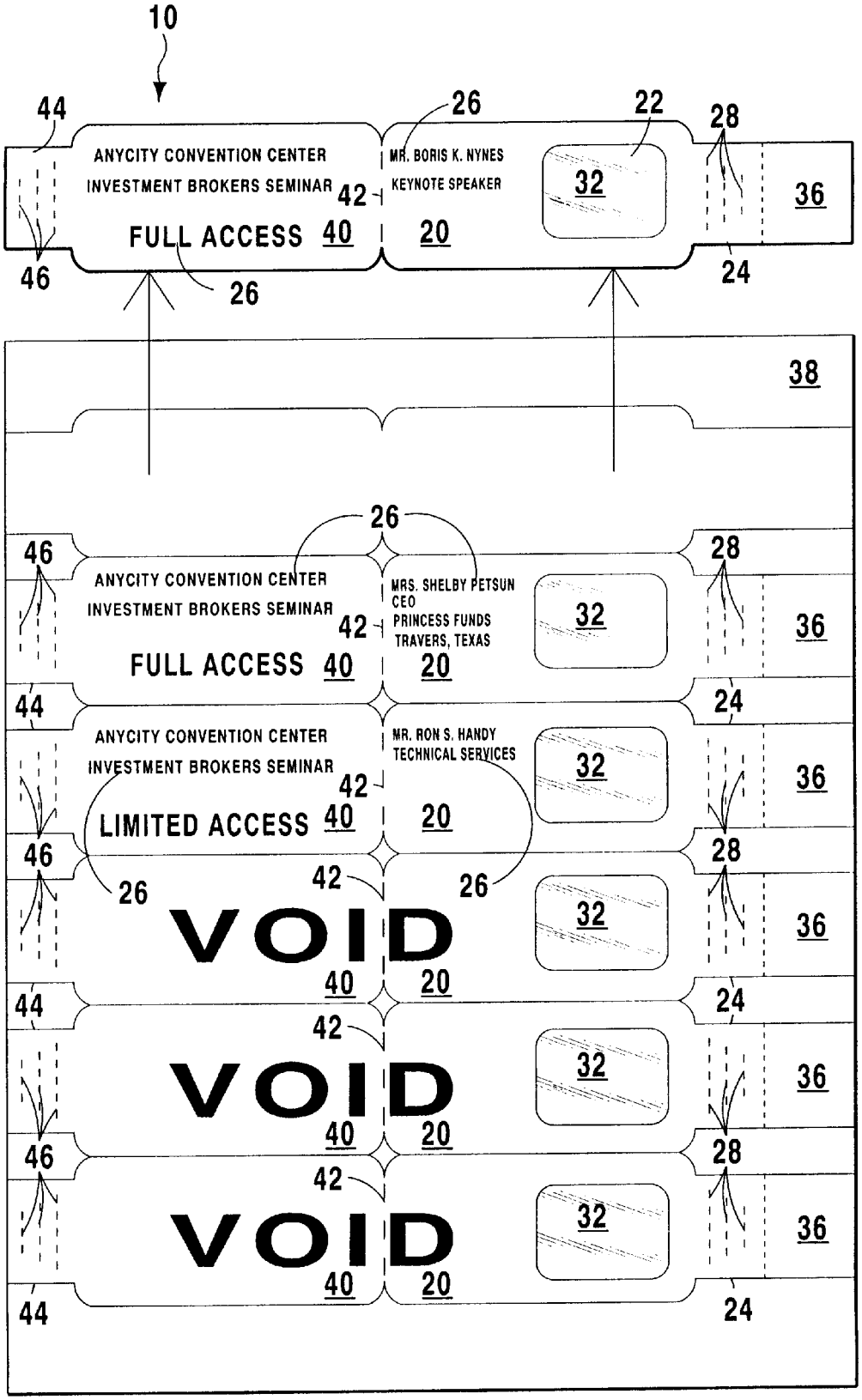
FIG. 4 is a front elevation of a full sheet of a plurality of foldable cards formed in accordance with the present invention including information printed on the first and second sides of the foldable cards.

A view of a full sheet 38 containing a plurality of folding cards 10 is also illustrated in FIG. 4. This figure illustrates the folding cards 10 including information 26 printed on the front and back sides 20 and 40, respectively. One of the folding cards 10 is shown being removed from the sheet 38 in the direction of the arrows labeled with the numeral 48 to expose the adhesive on the bottom side of the folding card 10. When a photograph is positioned below the transparent material 32 covering the window 22 and the front and back sides 20 and 40, respectively, are folded along the fold line 42, the adhesive material on the opposite side of the front and back sides 20 and 40 is caused to adhere together. The photograph 34 will thus be retained therebetween and in position beneath and viewable through the transparent material 32 covering the window 22. The tab 42 will align with the tab 24 such that the plurality of slits 46 match with the plurality of slits 28. The extension portion 36 of the tab 24 will extend beyond the length of the tab 42 thus providing an adhesive surface for adhering the folding card 10 to an article of clothing. As the front and back sides 20 and 40 are facing in the same direction when in an open position on the sheet 38, information can be applied to both the front and back sides when the sheet 38 is passed through a printer only a single time. Thus, the sheet 38 and/or each individual folding card 10 need not be passed through a printer twice, once on each side.

Figure 5:
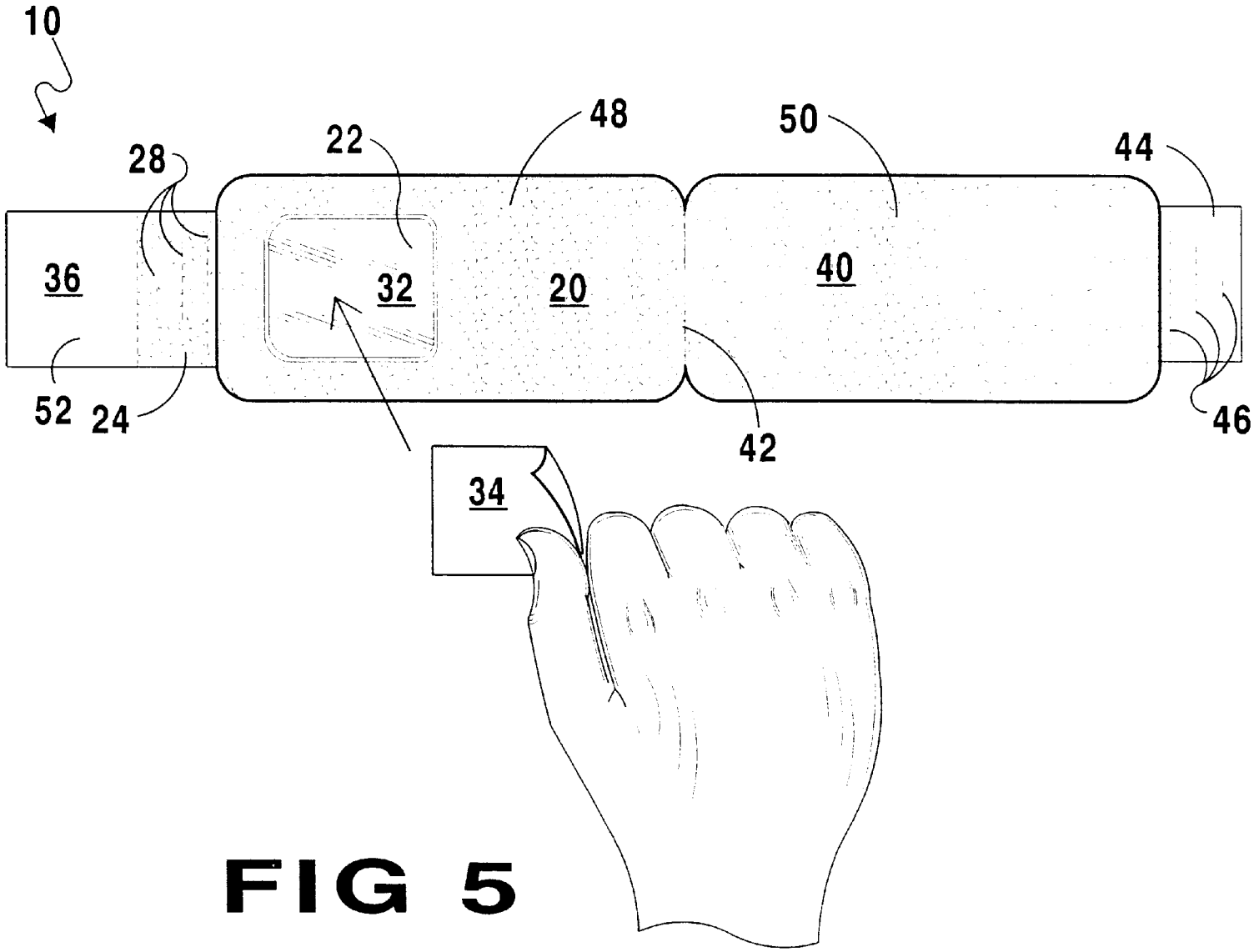
FIG. 5 is a rear elevational view of a foldable card of the present invention with a user positioning an insert behind the window in the first side.

A view of the back side 48 is illustrated in FIG. 5. From this view the adhesive material 50 on the bottom side of the front and back sides 20 and 40 is seen. The adhesive material 50 covers all of the bottom side 48 of the front side 20 except for the portion covered by the window 22 and all of the bottom side 48 of the back side 40. Alternatively, the adhesive material 50 may be positioned on the bottom side 48 of only one of the front and back sides 20 and 40. A cover 52 is positioned to cover the adhesive material on the extension portion 36 and is removed prior to adhering the folding card 10 to a piece of clothing. A photograph 34 is illustrated being positioned below the window 22 and when the folding card 10 is folded along the fold line 42, the adhesive material 50 will cause the front and back sides 20 and 40 to adhere together holding the photograph 34 in position therebetween. In this position, the tabs 24 and 44 are aligned and the slits 28 and 46 therein are also in alignment for receiving a button therethrough. The extension portion 36 extends beyond the tabs 24 and 44 when stuck together and upon removal of the cover 52 can be used to adhere the folding card 10 to a piece of clothing. The extension portion 36 may be connected to the tab 24 by perforations 54 and thus can be easily removed therefrom when it is desired to secure the folding card 10 to a button as opposed to adhering the extension portion 36 to a piece of clothing.

Figure 6:
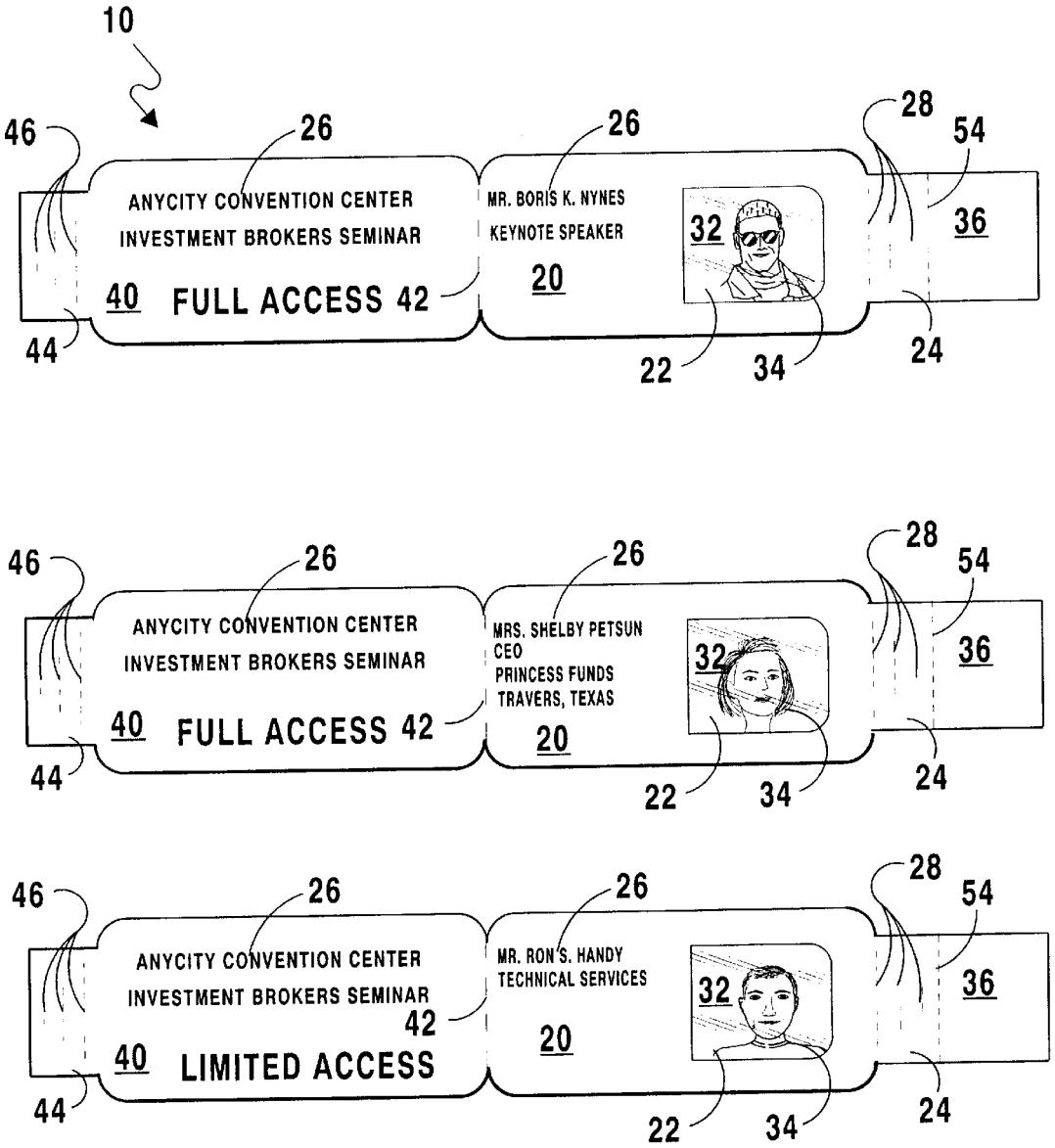
FIG. 6 is a front view of a plurality of cards of the present invention, each card including information printed on one side thereof and a photo inserted below the window on an opposing side thereof.

The top side of a number of folding cards 10 are illustrated in FIG. 6 in an open position wherein the front and back sides 20 and 40 are not adhered together. From this view it is readily seen that information may be printed on the front and back sides 20 and 40 during a single pass through a printer. The information on the back side 40 is printed to the left of the fold line 42 and the information on the front side 20 is printed to the right of the fold line 42. The photograph 34 is positioned below the transparent material 32 covering the window 22. The perforations 54 connecting the extension portion to the tab 24 are also clearly seen. The extension portion 36 is thus easily removed from its connection to the tab 24 by tearing along the perforations 54 when it is desired to secure the folding card using the slits 28 and 46 in the tabs 24 and 44.

Figure 7:
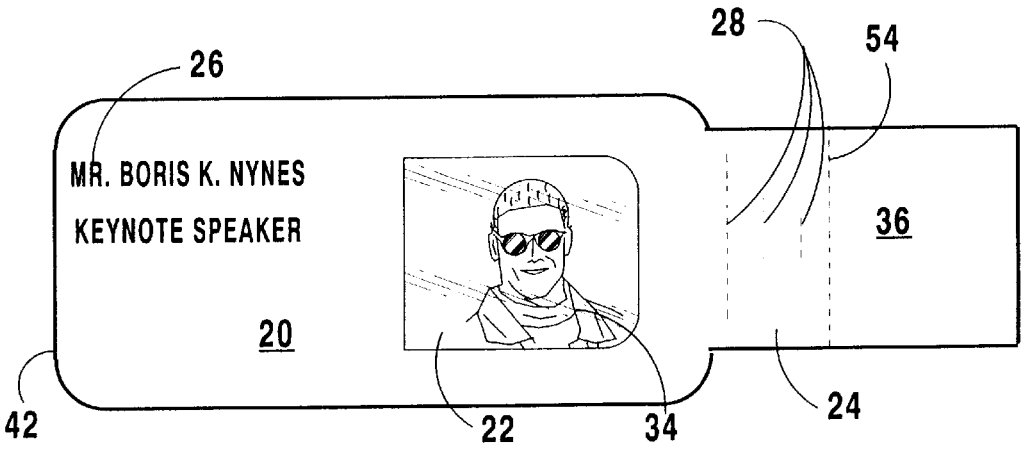
FIG. 7 is a front view of a card of the present invention folded along the fold line for securing the first and second sides together.

FIG. 7 illustrates the front side 20 of the folding card 10 in a closed/folded position. In this position, the photograph 34 is secured below and visible through the transparent material 34 covering the window 22. The tabs 24 and 44 are in alignment and thus the slits 28 in the tab 24 are aligned with the slits 46 in the tab 44. The extension portion 36 is provided extending from the tab 24.

Figure 8:
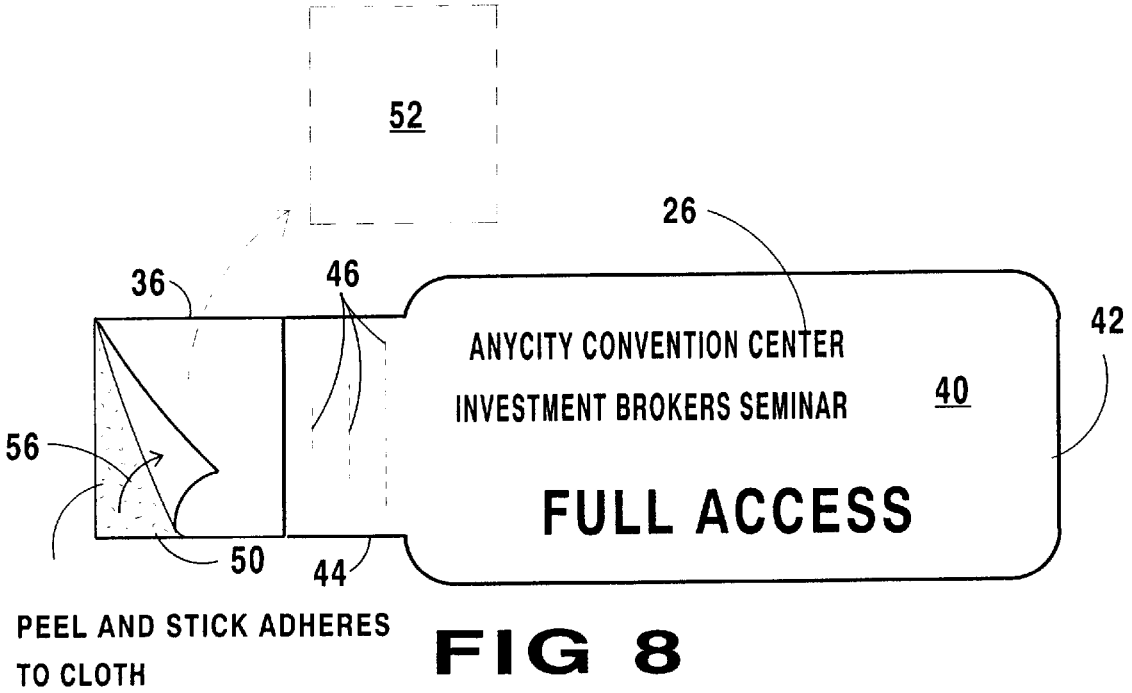
FIG. 8 is a back view of a card of the present invention folded along the fold line for securing the first and second sides together and showing the adhesive material on the tab being exposed.

A view of the back side 40 of the folding card 10 in the closed/folded position is illustrated in FIG. 8. As can be seen from this figure, the back side 40 of the folding card 10 includes information printed thereon and the tab 44 extending therefrom is aligned with the tab 24 of the front side 20 with the slits 46 aligned with the slits 28 in the tab 24. The extension portion 36 can be seen extending beyond the tab 46 and the cover 52 is illustrated in a partially removed state to show the adhesive material 50 positioned therebelow. When the cover 52 is removed by peeling in the direction indicated by the arrow labeled with the numeral 56, the adhesive material 50 therebelow will be exposed to allow the folding card 10 to be adhered to a piece of clothing. The arrow 58 illustrated in dashed lines indicates the total removal of the cover 52 from its position covering the adhesive material 50 on the extension portion 36. The removed cover 52 is also shown in dashed lines.

An insert positioned below the transparent material 32 covering the window 22 and secured between the front and back sides 20 and 40, respectively, when in a folded position may include a written or printed symbol, mark, photograph or other indicia conveying evidence or information pertaining to the authenticity, identification, privileges, and/or rights granted to the wearer of the identification card.

Figure 9:
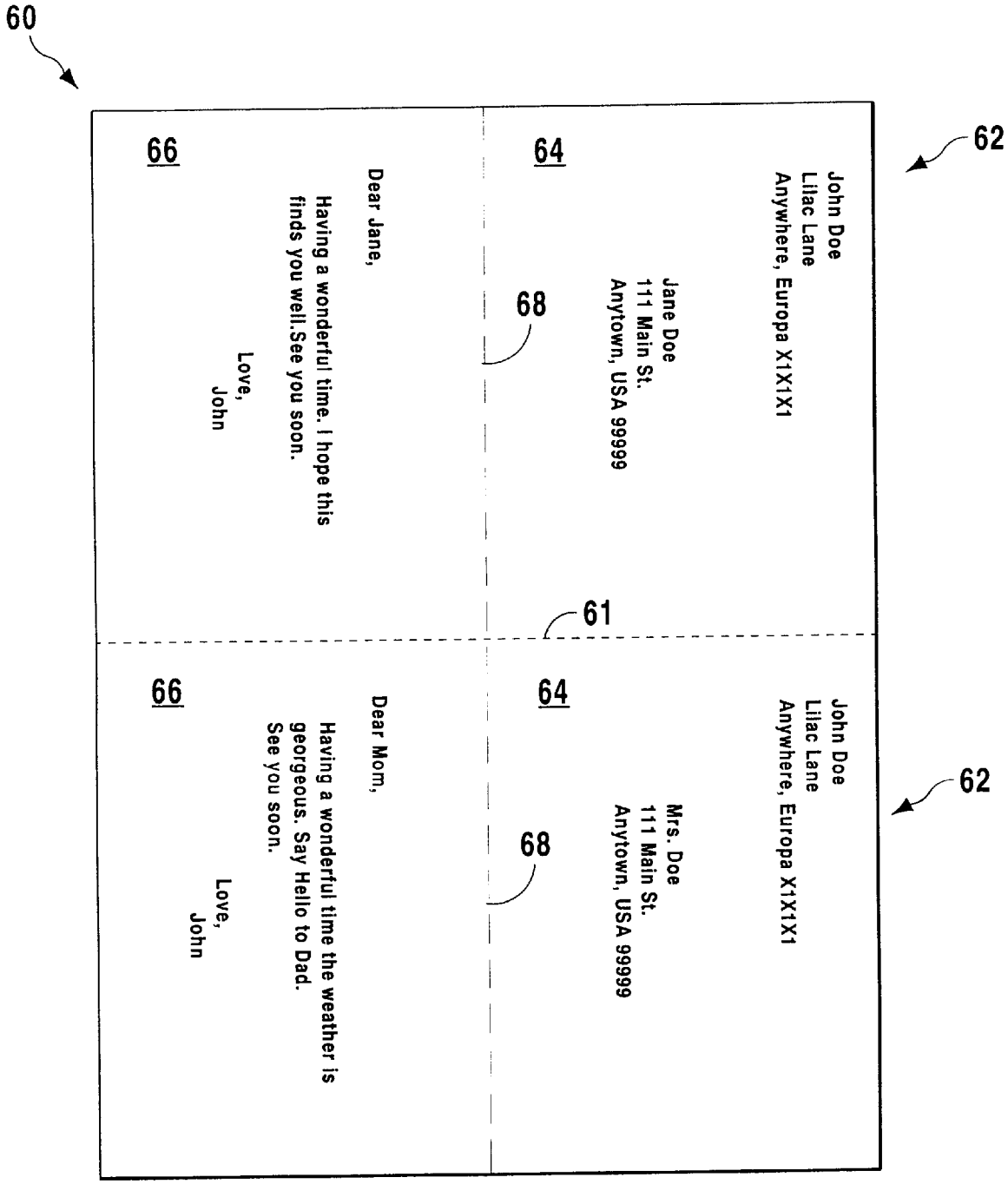
FIG. 9 is a front view of a sheet including a plurality of foldable cards of the present invention, each card including a message printed on one side and a mailing address on the other side, the card including an adhesive material on the side opposite the printed information.

FIGS. 9–13A illustrate the foldable cards of the present invention as a postcard. FIG. 9 illustrates a multi-ply sheet 60 including two postcards 62 thereon. The post cards 60 are releasably connected by a perforated line 61. A front surface 64 and a back surface 66 of each postcard 62 can be seen from this view. The post cards 62 are removably mounted onto the sheet 60 having the front and back surfaces 64 and 66, respectively, separated by a fold line 68 forming a printable facing ply thereby permitting printing of an address on the front side 64 and a message on the back side 66 in one pass through a printer. An adhesive material is positioned on an opposite side of the front and back surfaces 64 and 66, respectively, whereupon the post cards 60 are separated from each other by tearing along a perforation line and removed from a backing ply. When the post cards 60 is folded along the fold line 68 the adhesive on the bottom of the front and back sides will be caused to adhere together and become securely and unattachably engaged to form a mailable post card.

Figure 10:
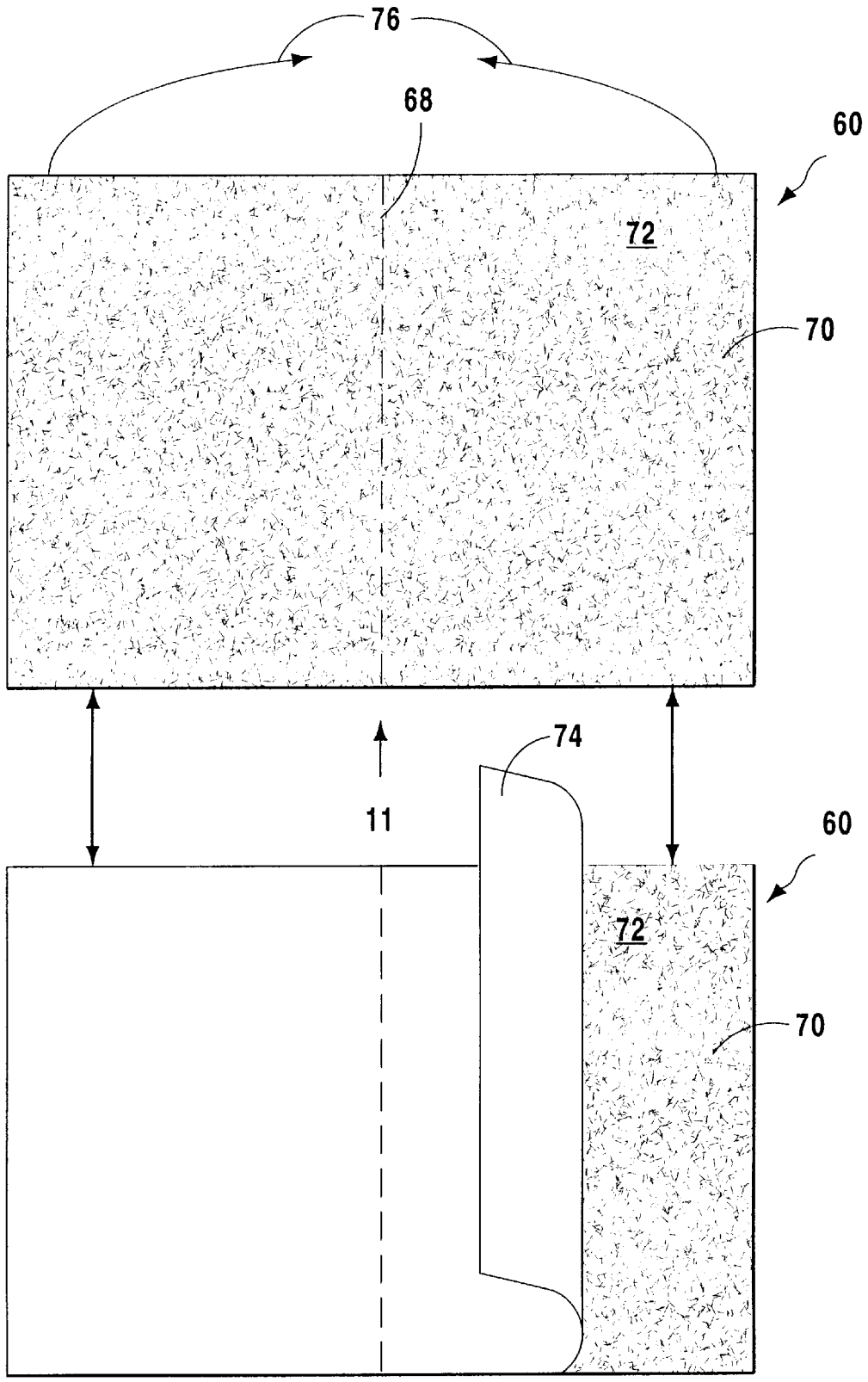
FIG. 10 is a back view of the foldable card of the present invention illustrating exposing of the adhesive material on one side thereof.
Figure 11:
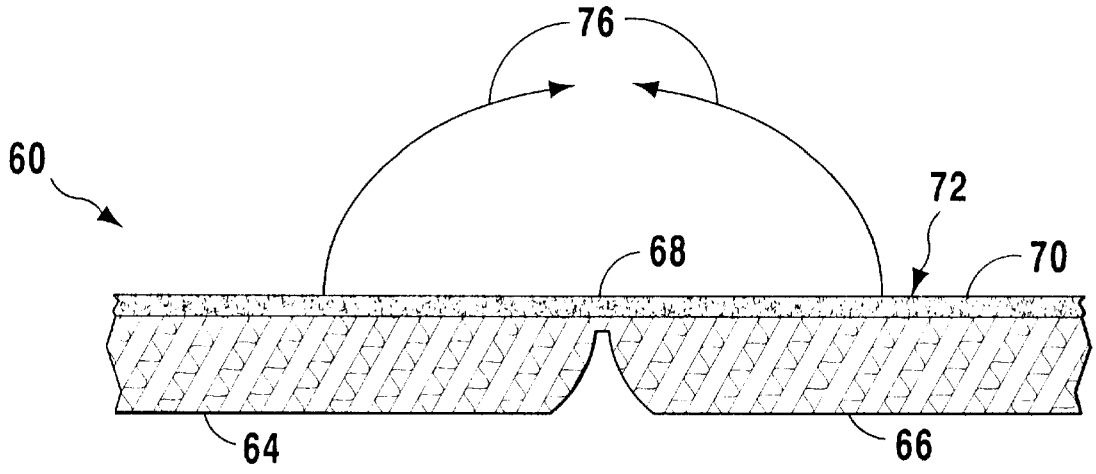
FIG. 11 is a side cross-sectional view of the foldable card of the present invention in an unfolded position taken in the direction of the arrow labeled 11 in FIG. 10.

A back side of the post card 60 is illustrated in FIG. 10. This figure illustrates formation of the post card 60. As can be seen, an adhesive material 70 is positioned on the bottom side 72 of the post card 60. The adhesive material 70 is covered by a removable cover 74 which when removed exposes the adhesive material 70. The cover 74 is removed by peeling away from the bottom side 72 and thereby exposing the adhesive material 70. The front and back sides of the post card 60 are then folded towards each other along the fold line 68 in the direction of the arrows labeled with the numeral 76. When the front and back sides contact each other they are caused to adhere together forming a post card 60 with the front and back surfaces 64 and 66, respectively, being exposed.

Figure 12:
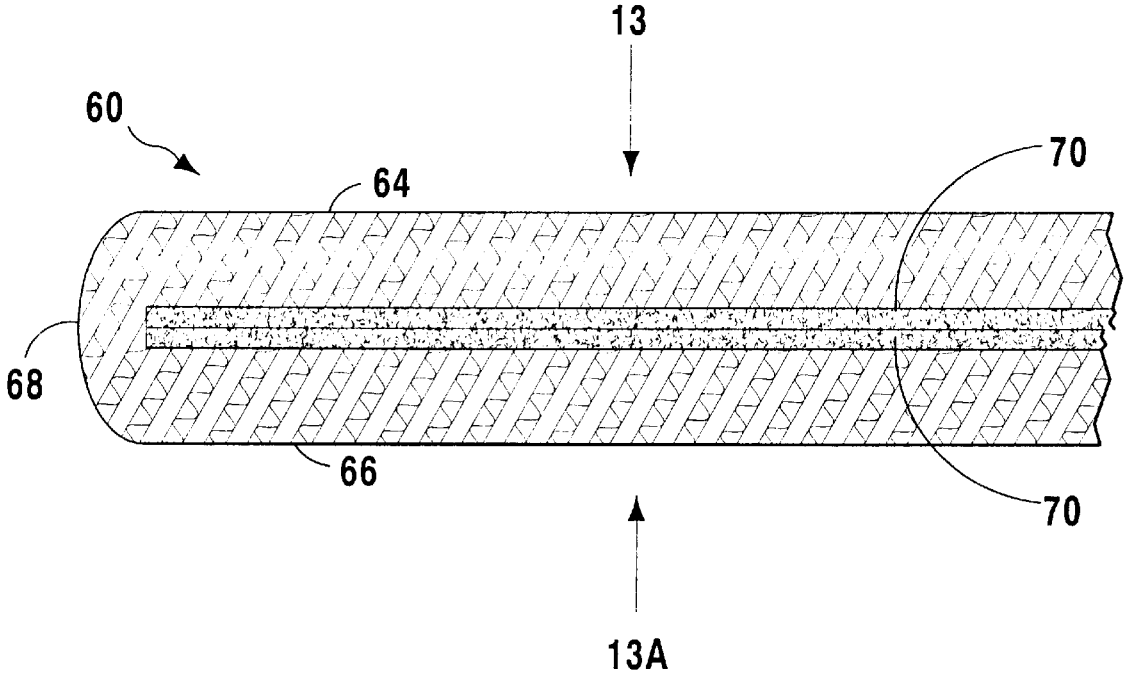
FIG. 12 is a side cross-sectional view of the foldable card of the present invention in a folded position
Figure 13:
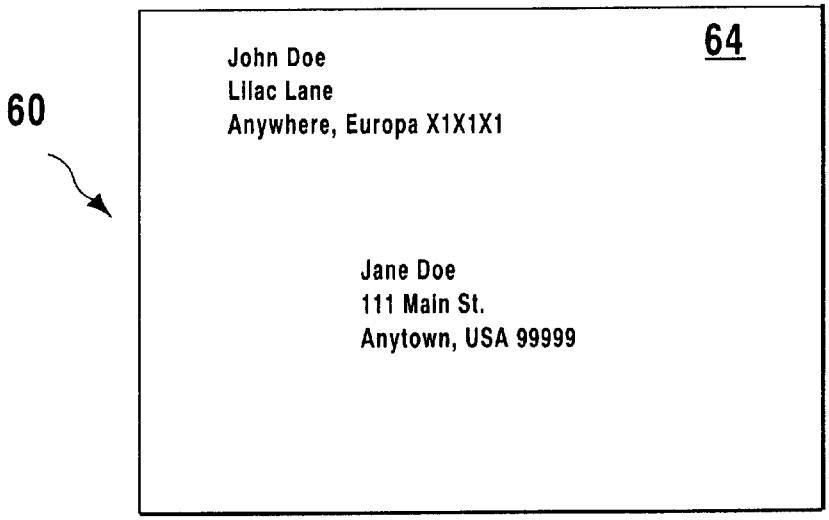
FIG. 13 is a front view of the foldable card of the present invention in the folded position forming a post card.
Figure 13A:
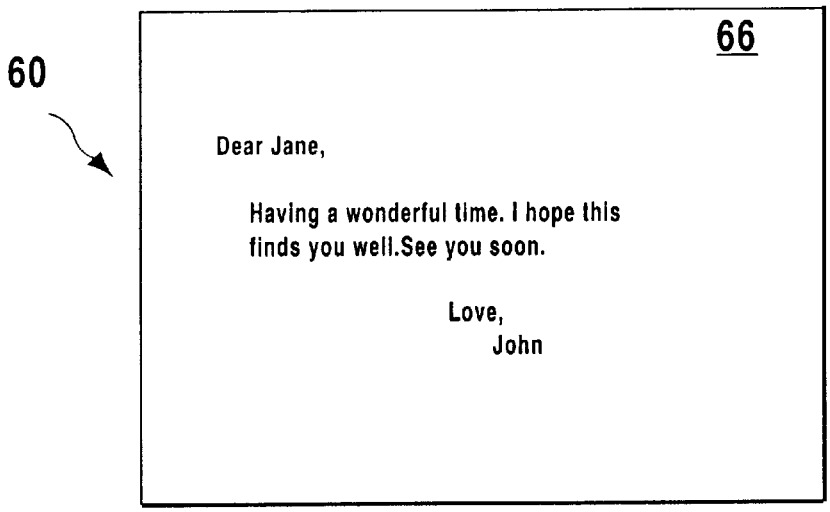
FIG. 13A is a back view of the foldable card of the present invention in the folded position forming a post card.

A side cross sectional view of the post card 60 taken in the direction of the arrow labeled 11 in FIG. 10 is illustrated in the open or unfolded position. A view of the post card 60 in the folded position is illustrated in FIG. 12. In the unfolded state, the adhesive material on the front and back sides is separated and the post card 60 lies flat. When the front and back sides are folded towards each other along the fold line 68 as indicated by the arrows 76, the adhesive material on the front and back sides will become engaged and cause the front and back sides to become secured together as shown in FIG. 12. The dimensions of the front and back sides are substantially similar and thus when folded along the fold line 68, the front and back sides will be in alignment. A top view of the front surface 64 of the post card 60 taken in the direction of the arrow labeled 13 in FIG. 12 is illustrated in FIG. 13 showing the mailing address printed thereon. A bottom view of the back surface 66 of the post card 60 taken in the direction of the arrow labeled 13A in FIG. 12 is illustrated in FIG. 13A showing a message printed thereon.

The method of forming an information and post cards of the present invention will now be described with reference to the figures. A plurality of information cards may be provided on a single multi-ply sheet. The multi-ply sheet includes a backing layer and a printable layer. The printable layer includes a top printing surface and a back surface containing an adhesive material thereon. The adhesive material acts to releasably secure the printable layer to the backing layer.

The printable layer is formed of a front side and a back side connected at a folding line. The front and back layers are of substantially similar dimensions. The printable layer may be in any form, e.g. a tag or post card, as is illustrated in the figures.

When in the form of a tag, the printable layer may be of any geometrical shape and preferably includes a window extending through one of the front and back sides for placement of an item containing information about the user therebehind. A tab may also be provided to extend from the front and back sides, the tab extending from the front being of substantially similar dimensions to the tag extending from the back side. The tab extending from the front side may include a removable extension portion including an adhesive material on one side thereof for use in adhering the tag to an object or article of clothing. The tabs extending from the front and back sides also include a plurality of different sized slits extending therethrough for receiving a button and thereby attaching the card to an article of clothing.

When in the form of a post card, the front and back sides may be in any geometrical shape and connected together along a fold line. The front and back sides are of substantially the same dimensions.

When desired to use the card, the information desired to be printed thereon is entered into a computer or written on the printable side of the card. If the information is entered into a computer, the sheet is passed through a printer so that the information entered into the computer can be printed on the printable side.

Once the information is printed on the front and back sides of the card, the card is removed from its adherence to the backing sheet thereby exposing the adhesive material. If one side of the card includes a window, an item of information desired to be viewed through the window is positioned such that the information is placed against and viewable through the transparent material covering the window. The front and back sides are then folded along the fold line such that the adhesive material on the front side engages the adhesive material on the back side thereby adhering the front and back sides together. If an item was positioned to be viewed through the window, the adherence of the front side to the back side retains the positioning of the item viewable through the window. The information printed on the front and back sides is viewable to a person viewing the card and the card need only be passed through a printer only one time.

From the above description it can be seen that the foldable cards of the present invention is able to overcome the shortcomings of prior art devices by providing a foldable cards which is able to be formed on a multi-ply sheet comprising a printable ply and a backing ply including an adhesive material positioned on one side of the printable ply wherein a plurality of folding cards may be formed on a single multi-ply sheet. Each foldable card includes first and second sides connected along a fold line wherein information may be printed on both the first and second sides of the printable ply during a single pass of the sheet through a printer and a window positioned on one of the first and second sides thereof for viewing an item inserted between the first and second sides when the card is folded along the fold line. Each foldable card may also have a tab extending from at least one of the first and second sides including at least one of an adhesive material positioned on a portion of the tab for selectively adhering the card to clothing surfaces and a slotted portion having a plurality of various sized slits extending therethrough for receiving a clothing button therethrough. Alternatively, the foldable card can be in the form of a post card having a front side and a back side joined together along a fold line and releasably secured to a sheet by an adhesive material, whereby the side opposite the adhesive material allows for printing an address on the front side and a message on the back side of the foldable card during a single pass through a printer. Furthermore, the foldable cards of the present invention are simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A foldable card for providing information to a user, said foldable card comprising:

a) a backing sheet;

b) a printable sheet having a first section and a second section connected together at a fold line, said first and second sections having substantially similar dimensions;

c) an adhesive material positioned on one side of said printable sheet for releasably securing said printable sheet to said backing sheet, wherein information is printable on a side of said first and second sections opposite said adhesive material during a single pass through a printer and when said printable sheet is removed from engagement with said backing sheet and folded along said fold line, said adhesive material on said first and second sections is caused to adhere said first and second sections together allowing the information printed on both said first and second sections to be viewable;

d) first and second tabs extending from a respective one of said first and second sections;

e) an extension portion extending from said first tab, said extension portion extending beyond said second tab when said foldable card is folded along said fold line and includes an adhesive material on one side thereof for selectively adhering said foldable card to an object.

2. The foldable card as recited in claim 1, wherein said first and second sections are in the shape of a postcard wherein the information printed on said first section is an address of a person to which said post card should be delivered and the information printed on the second section is a message thereby allowing said post card to be mailed.

3. The foldable card as recited in claim 1, wherein one of said first and second sections includes a window through which an item positioned between said first and second sections is viewable.

4. The foldable card as recited in claim 3, further comprising a transparent material covering said window and thereby protecting the item viewable therethrough.

5. The foldable card as recited in claim 4, wherein said item is a photograph.

6. The foldable card as recited in claim 5, wherein the information printed on said first and second sections relates to a wearer of said foldable card.

7. The foldable card as recited in claim 1, wherein at least one of said first and second tabs include an adhesive material positioned on one side thereof.

8. The foldable card as recited in claim 1, wherein said first and second tabs are caused to be secured together when said foldable card is folded along said fold line.

9. The foldable card as recited in claim 8, further comprising at least one slit extending through both said first and second tabs for receiving a button therethrough to releasably secure said foldable card to an object.

10. The foldable card as recited in claim 9, further comprising a plurality of different sized slits extending through both said first and second tabs, each slit being sized to receive a particular size button and wherein said slits extending through said first tab are aligned with said slits extending through said second tab when said foldable card is folded along said fold line.

11. The foldable card as recited in claim 1, wherein said extension portion is releasably secured to said first tab.

* * * * *